United States Patent [19]

Kulka

[11] 4,383,343

[45] * May 17, 1983

[54] FOOT SUPPORTING STRAP FOR HOSPITAL BED

[76] Inventor: Thomas S. Kulka, 2108 Payne Ave., Cleveland, Ohio 44114

[ * ] Notice: The portion of the term of this patent subsequent to Oct. 14, 1992, has been disclaimed.

[21] Appl. No.: 192,635

[22] Filed: Sep. 30, 1980

Related U.S. Application Data

[63] Continuation-in-part of Ser. No. 65,151, Aug. 9, 1979, Pat. No. 4,227,271.

[51] Int. Cl.[3] ..... A47C 21/00

[52] U.S. Cl. ..... 5/443; 5/508

[58] Field of Search ..... 5/443, 444, 445, 424, 5/503–508

[56] References Cited

U.S. PATENT DOCUMENTS

| | | | |
|---|---|---|---|
| 908,845 | 1/1909 | Curtin | 5/445 |
| 1,502,276 | 7/1924 | Siebert | 5/424 |
| 2,524,429 | 10/1950 | Devin | 5/424 |
| 2,843,858 | 7/1958 | Bjorklund | 5/445 |
| 2,927,329 | 3/1960 | Johannis | 5/445 |
| 3,134,512 | 5/1964 | Sharkey . | |
| 3,535,719 | 10/1970 | Murcott | 5/424 |
| 3,803,645 | 4/1974 | Oliverius | 5/505 |
| 3,878,844 | 4/1975 | Tobias | 5/424 |
| 3,966,200 | 6/1976 | Kirk | 5/508 |
| 4,214,328 | 7/1980 | Custer et al. | 5/424 |
| 4,227,271 | 10/1980 | Kulka | 5/443 |

FOREIGN PATENT DOCUMENTS

| | | | |
|---|---|---|---|
| 74680 | 4/1950 | Denmark | 5/443 |

*Primary Examiner*—Alexander Grosz

*Attorney, Agent, or Firm*—Schwartz, Jeffery, Schwaab, Mack, Blumenthal & Koch

[57] ABSTRACT

A foot supporting strap for beds including a strap detachably secured to the frame of or other parts of a bed. Means are associated with the strap for spacing the strap from the mattress thereby to form a space into which the feet of the patient can at least partially extend. The strap thus provides a brace against which the feet of the patient can push to permit movement of the patient to a more comfortable position.

6 Claims, 12 Drawing Figures

FOOT SUPPORTING STRAP FOR HOSPITAL BED

REFERENCE TO RELATED APPLICATION

The present application is a continuation-in-part of my earlier, pending application filed Aug. 9, 1979, Ser. No. 065,151 now U.S. Pat. No. 4,227,271, bearing the same title.

BACKGROUND OF THE INVENTION

The present invention relates as indicated to a foot supporting strap for a hospital bed. The invention is specifically designed to provide substantial footing for patients who are to some degree immobile, with the invention permitting the patient to bring his or her body into a comfortable position and to be retained in such position.

There are known prior art devices for assisting the movement of a patients while lying on their back in a hospital bed. U.S. Pat. No. 908,845 to Curtin, for example, discloses a lift strap for a recumbent patient by means of which the patient is able to pull himself up to a sitting position. The device is anchored to a foot post of the bed and can be easily grasped by the patient. Similar devices are disclosed in U.S. Pat. Nos. 2,843,858 and 2,927,329.

U.S. Pat. No. 3,134,592 to Sharkey discloses a foot-restraining exercise device which can be mounted on the foot board of the bed to facilitate patient exercise. However, the device is relatively inflexible in regard to the position thereof relative to the foot boards and the area thereof for accommodating the feet of the patient for exercise purposes.

U.S. Pat. No. 3,535,719 discloses a body restraining device in the form of a band or strap which can extend tightly over the arms and/or legs of the patient, and appropriately tightened. The opposite ends of the band or strap are secured to rails provided at the sides of the support member, which can comprise a stretcher, table or the like. However, once the restraining devices are tightened, it is very difficult for the patient to move his body whereby the patient is oftentimes required to be retained in a position of relative discomfort.

SUMMARY OF THE INVENTION

The present invention comprises a novel foot supporting strap which permits the patient to maintain his body in a comfortable position while lying immobile in bed. The strap can be formed of any suitable material, and in one form of the invention is adapted to receive at the opposite ends thereof fastening hooks which can be removably secured to anchoring means mounted on the bed frame. Although a single wedge can be used, a plurality of blocks or wedges are preferred and are secured either to the underside of or around the strap in longitudinally spaced arrangement. The bottom surfaces of the wedges engage the mattress, or the sheets and/or blankets covering the mattress, and thereby position the strap therefrom. Thus, there is provided a space between adjoining wedges and beneath the strap into which the toes of the patient can extend, with the penetration of the feet depending upon the degree to which the strap is tightened relative to the bed frame. In this manner, the strap effectively serves as a brace for the patient thereby permitting him or her to assume the most comfortable position.

In other forms of the invention, the strap is secured in various manners to the bed frame or other parts of the bed, such as the side rails, so as to accommodate various bed constructions. For example, in more modern bed constructions, the bed frame, by suitable cranking, can be elevated at different locations along the frame, thereby making a fixed connection area of the strap to the frame relatively more impractical and limiting in terms of utilization of the invention concepts.

An advantage of the invention is that it readily permits the patient to move his or her body toward the head of the bed, out of uncomfortable positions resulting from the patient sliding toward the foot of the bed. As well understood by those in the art, most hospital beds can be inclined at the top or foot of the bed, or both, and a common bed position is where the top of the bed is inclined so that the upper portion of the body of the patient is raised. This raised position inevitably causes movement of the patient toward the foot of the bed thereby rendering it very difficult for a patient who is immobile to move his body back into a comfortable position. The supporting strap in accordance with the present invention readily permits such movement by manipulation of the feet of the patient, without in any way affecting other parts of the body which are required to be maintained immobile.

These and other objects of the invention will become apparent as the following proceeds, in particular reference to the application drawing.

BRIEF DESCRIPTION OF THE APPLICATION DRAWING

Referring to the application drawings.

Figure 11:
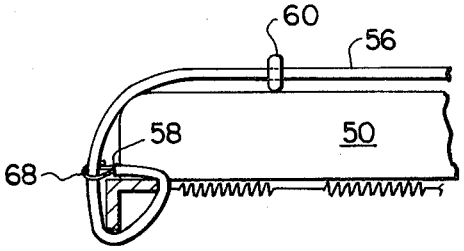
Figure 12:
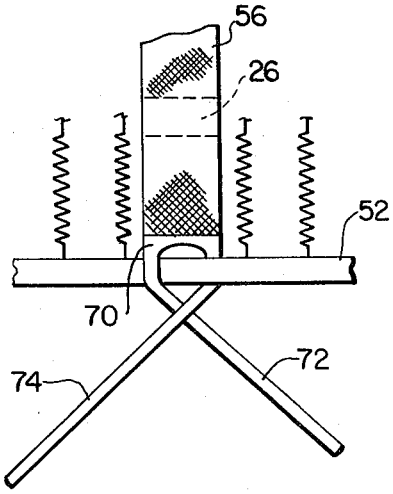

FIG. 11 is a frgmentary end view similar to FIG. 10, but showing a further modification in which the ends of the strap are formed with snap hooks so as to permit the strap to be tightened in a taut condition, and FIG. 12 is a fragmentary plan view of another modification in which the ends of the strap comprise two separate end portions which extend above and below the frame and which can be tied together to maintain the strap taut.

DETAILED DESCRIPTION OF THE PREFERRED EMBODIMENTS

Figure 1:
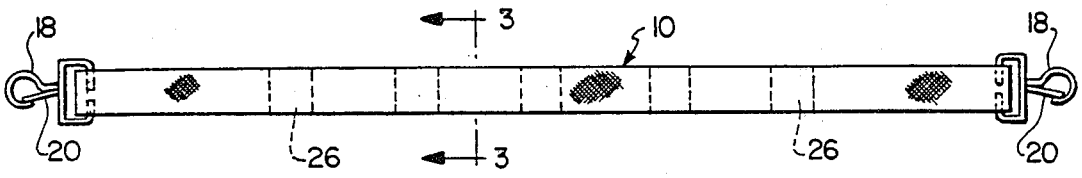
FIG. 1 is a top plan view of the foot supporting strap constructed in accordance with the present invention.
Figure 2:
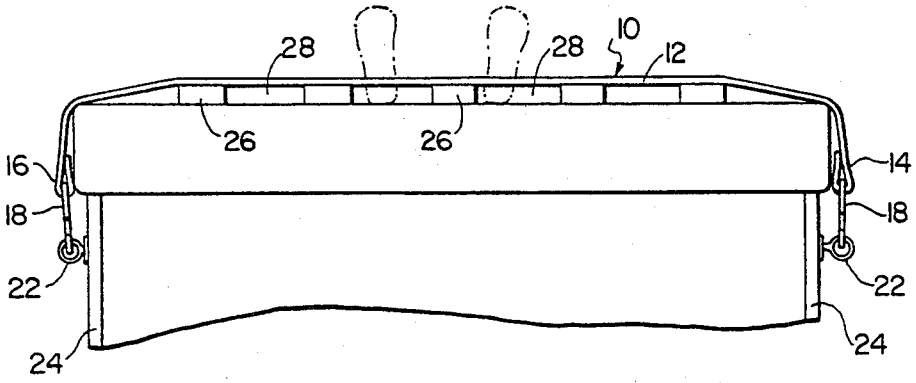
FIG. 2 is an end view of the strap, showing the manner in which it is attached to the bed frame, with the feet of the patient being shown partially in dashed lines.
Figure 3:
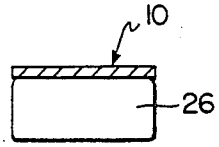
FIG. 3 is a sectional view taken on line 3—3 of FIG. 1.

Referring now in more detail to the application drawings, wherein like parts are indicated by like reference numerals, and initially to the form of the invention illustrated in FIGS. 1–3, the foot supporting strap in accordance with this form of the invention is generally flat, and of web-like construction. The strap can be made of textile, nylon or other suitable durable material, and can be made from a flexible material if desired. The strap is of sufficient length that the body portion 12 thereof extends entirely across the width of the bed, as shown in FIG. 2. Each end 14 and 16 of the strap is bent over to form a loop, with the free ends being secured to the strap so that the loops thus formed are permanent.

Fastener hooks commonly designated at 18 are secured to the ends of the strap, through the loops 16, as shown in FIG. 1. Each hook includes a flexible arm 20 which can be resiliently pressed inwardly of the hook to permit the same to be attached to eyelets designated at 22 secured to the frame 24 of the bed relatively adjacent the foot thereof. It will be understood that the length of the strap is such that the strap is reasonably taut when the fastening hooks are secured to the eyelets 22 as shown in FIG. 2. Alternatively, the strap can be formed with straight ends having openings through which a turn bolt can extend for threaded connection with a nut positioned adjacent the frame. If desired, the bolt and nut can be constructed and arranged for increasing the tension on the strap as the bolt is tightened.

Wedge members commonly designated at 26 are secured to the underside of the strap 10, by bonding or the like, and are spaced longitudinally along the strap as shown in FIGS. 1 and 2. Adjacent wedges thus define with the underside of the strap and the top of the mattress, or coverings therefor, a generally rectangular space 28. The wedges or blocks 26 can be formed of any suitable material, for example, foam rubber, polyurethane, or other generally soft or rigid materials. However, the wedges or blocks must be sufficiently firm to prevent the web from approaching contact with the mattress, which position would make it very difficult to accomplish the basic objectives of the supporting arrangement. Although more than two wedges are shown in FIG. 2 a pair of wedges could be provided, spaced relatively adjacent the edges of the mattress. It will be noted that the wedges could comprise materials such as sponge rubber or polyurethane wrapped in a moisture-proof wrapper to facilitate ease of cleaning the strap assembly and thus maintaining sanitary conditions. Likewise, the belt can be made of material which is inherently self-cleaning, or, alternatively, wrapped in a moisture-proof casing. In either case, the wedges or blocks are secured to the underside of the strap.

In the normal use of the foot supporting strap, the ends of the strap are secured to the eyelets 22 through the fastening hooks 18. As noted, the length of the strap is such that when the strap is fastened as shown, it is reasonably taut thereby to provide a brace against which the feet of the patient can engage and push to reposition the patient to a comfortable position. To accomplish this, the toes of the patient are positioned in spaces 28 between adjacent wedges and the feet extended until the arch of each foot engages the underside of the strap. Using the strap as a brace or a surface against which force can be applied, the patient then moves his body backwardly until a comfortable position is assumed. It will be understood that at the initiation of movement, the knees of the patient may be substantially bent due to the sliding of the patient toward the foot of the bed, particularly when the head section of the bed is elevated as above described. This is a normal position for reading, viewing television, and receiving visitations, and it is extremely difficult for the patient to maintain a sitting position without undergoing some movement toward the foot of the bed. With the knees thus flexed, force applied by the feet to the strap permits the body to be moved toward the head of the bed.

Once a comfortable position has been assumed, the patient can remove his feet from the strap, or maintain his toes loosely in the spaces 28 for possible further movement. Since the mattress is resilient, it is possible for the patient to extend his entire foot through the openings 28, by compressing the mattress the application drawing illustrates the feet of the patient. However, it will be understood that in such position the patient has lost the ability to reposition his body unless and until the feet are withdrawn from the openings 28 and the procedures above described again undertaken.

It will be seen that the invention is of particular advantage for patients whose arms and back may be immobile. Normally, hospital beds are provided with side bars which can be grasped by the patient to reposition his body, but if the arms are immobile this method of repositioning is precluded. Likewise, with back ailments movement is severely restricted in terms of lifting one portion of the body relative to the other due to the stress placed on the back. By permitting movement of the body with the feet in accordance with the present invention, the repositioning can be effected without the use of the arms or lifting of the body.

Figure 4:
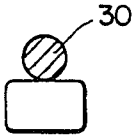
FIG. 4 shows a modified form of the invention in which the strap is generally cylindrical in cross section, with a wedge or block being shown attached to the strap.
Figure 5:
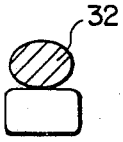
FIG. 5 is a view generally similar to FIG. 4, showing a further modification of the invention in which the strap is generally oval in cross section.
Figure 7:
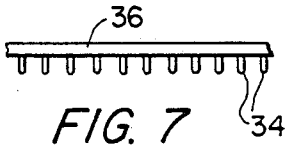
FIG. 7 illustrates another modification of the strap construction in which the strap is formed on the underside thereof with projections to enhance gripping of the strap.

The strap can take other forms than the flat form shown in FIGS. 1–3. Referring to FIGS. 4and 5, for example, the strap may be generally cylindrical as shown at 30, or oval as shown at 32. FIG. 7 shows a further form of the strap in which a plurality of projections in the form of transverse webs 34 are provided which serve to space the strap 36 from the surface of the mattress. The webs 34 are resilient so as to permit the feet of the patient to be inserted beneath the same for repositioning of the patient as above described.

Figure 6:
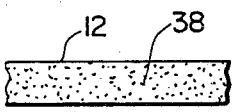
FIG. 6 is a fragmentary showing of a strap of a still further modified form of the invention in which the strap is formed with an anti-slip surface.

The strap 12 may be provided with an anti-slip surface 38 as shown in FIG. 6, which facilitates the frictional engagement between the feet of the patient and the underside of the strap thereby to enhance repositioning of the patient.

Figure 8:
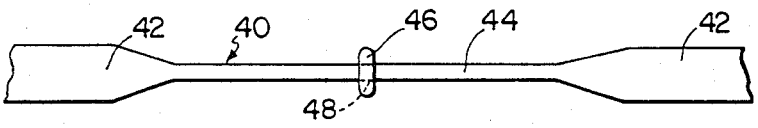
FIG. 8 shows a still further form of the invention in which the strap is of non-uniform configuration, and the wedge extends around an area of reduced dimension of the strap.

FIG. 8 shows a still further form of the invention in which the strap generally indicated at 40 includes wide, normally flat portions 42, and a narrow strap portion 44. The wide portions 42 prevent the strap from twisting. In the form shown, a generally circular wedge member 46 is positioned around the flat portion 44, with the member 46 being formed with a slot 48 through which the webbed portion 44 extends. The lower half of the wedge 46 thus performs in the same manner as the wedge members 26 in the FIGS. 1–3 form of the invention. Due to the slot 48, the wedge 54 can be positioned at any desired location along the narrow strap portion 44. It will be apparent that the wedge can also be in the shape of a ball. Also, a wedge or ball could be positioned around the wide strap portions 42, and suitably apertured as described. Flat wedges could also be provided, secured to the underside of the strap portions 42. A single wedge, as shown in FIG. 8, can be employed, provided that the wedge raises the strap sufficiently from the mattress or covering surface to permit the feet to engage under the strap.

As above noted, modern hospital beds frequently are of the type in which the frame may be vertically adjusted in longitudinally intermediate portions of the frame. Thus, in addition to the top of the frame being elevatable, a point relatively adjacent the bottom of the frame and likewise be elevated, due to the hinging of the frame in such location, so as to provide the desired rest position for the patient. The vertical movement of the hinged bed portions can be adjusted as described, normally by cranking means, and in certain more elevated positions of adjustment, the position of fixed eyelets of the type shown in FIG. 2 are impractical. While the strap can be maintained taut in one position of vertical adjustment, such tautness will be either lessened or will inhibit vertical adjustment of the bed frame in that area when adjustment is made upwardly or downwardly. It is therefore desirable to provide a strap constructed and arranged relative to the bed frame or other parts that can be conveniently employed with bed frames having multiple adjustment features of the type described.

Figure 9:
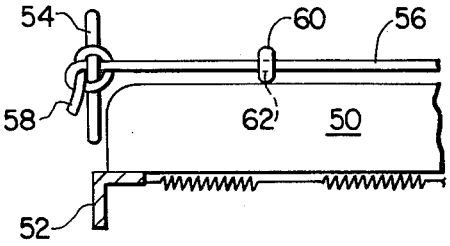
FIG. 9 is a fragmentary end view of a modification in which the strap can be wrapped around and securely tied to the side rails of the bed, thereby accommodating bed frames capable of multiple adjustment.

Referring to FIG. 9, which comprises a fragmentary end elevational view, the mattress 50 is shown supported by the bed frame rail 52. A side rail 54 is positioned at each side of the mattress, and can be mounted in any known manner to either the frame 52 or end frame members (not shown). The mounting of the side rails is normally such that either one or both of the rails can be elevated as shown in FIG. 9, or lowered to permit the patient to get off of or on the mattress. The construction and mounting of the side rails forms no part of the present invention, and the side rail in FIG. 9 has been shown only schematically.

The strap 56 in FIG. 9 can be formed of any suitable material and cross-sectional shape. As shown, the strap is generally circular, but it could as well be formed flat as shown in FIG. 8. The strap has free ends 58, only one of which appears in FIG. 9. A wedge member 60 extends around the strap 56, and is formed with a diametral opening 62 through which the strap extends. It will be understood that a single wedge can be employed as shown in FIG. 8, or a plurality of wedges as shown in FIGS. 1 and 2, with the important consideration being that the wedge serves to space the strap from the adjacent surface of the mattress so as to permit the feet of the patient to be positioned between the strap and the mattress.

To secure the strap 56 in a taut condition in the FIG. 9 form of the invention, each end 58 of the strap is wrapped around a portion of the side rail and knotted or otherwise secured thereto as shown in FIG. 9. It will be understood in this regard that the side rail construction normally comprises a pair of generally horizontal top and bottom rail members, and vertically disposed rail members interconnected therebetween. The strap 56 can thus be moved to a convenient and functional location relative to the longitudinal direction of the mattress, and the free ends wrapped around and secured to the rails. The FIG. 9 form of the invention thus provides flexibility where bed frames are constructed to include hinged sections generally adjacent the bottom of the bed and where such sections can be elevated as desired by a crank or the like. If the hinged sections are raised, the strap 56 can simply be untied at the ends thereof, the sections raised, and the strap thereafter retied to maintain the strap in a taut condition. It will be understood that in the event the hinged sections are lowered whereby the bottom of the mattress is essentially planar, an unacceptable space is then created between the bottom of the strap 56 and the mattress. In such event, the mattress ends are again loosened, and retied so that the strap is taut relative to the adjusted mattress surface.

Although a wedge of the type shown in FIG. 8 and having an opening through to receive the strap has been shown in FIG. 9, it will be understood that one or more wedge members of the type shown in FIGS. 1 and 2 can alternatively be provided to achieve the intended result.

Figure 10:
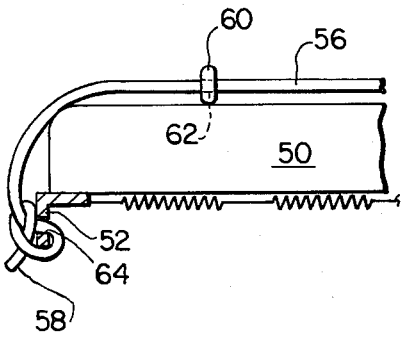
FIG. 10 is a fragmentary end view of a further modification in which the ends of the strap can extend through an opening in the frame and then wrapped and knotted to secure the strap in taut condition.

Referring to FIG. 10, the strap 56 shown therein is identical or similar to the strap shown in FIG. 9. However, in FIG. 10, each end 58 of the strap extends through an opening 64 formed in the vertical side leg of the frame 52, with each free end thereafter being wrapped about itself and knotted or otherwise secured relative to the frame. The vertical side of each frame member is normally provided with a plurality of such apertures 64, and the strap 56 can therefore be longitudinally adjusted as desired. As above described with reference to FIG. 9, in the event the frame is vertically adjustable relatively adjacent the bottom thereof through the provision of hinged sections, the end 58 of the strap can simply be loosened and, following adjustment of the frame, again tightened so as to maintain the strap in a taut condition. In the event the strap can be maintained taut during vertical adjustment of the frame sections, obviously loosening and retightening of the strap will now be necessary. However, when the frame sections and consequently the mattress are adjustably inclined, the proper position of the strap relative to achieving comfortable and maximum leverage on the strap can be altered, in which event the strap can be adjusted longitudinally as desired to the proper location or loosened and retied.

The FIG. 11 form of the invention is similar in most respects to FIG. 10, and the same reference numerals have been applied. However, in FIG. 11 a snap hook 68 is secured to each free end 58 of the strap 56. In addition, the end of the strap is wrapped around the frame 52 rather than extending through an opening therethrough as shown in FIG. 10. Although a single such wrap is shown in FIG. 11, it will be understood that, depending upon the length of the strap and the vertical adjustment of the bed frame and consequently the mattress, a plurality of turns may be necessary to achieve the desired tautness. Once achieved, the snap hook is hooked around the adjacently disposed portion of the strap thereby preventing the wrapped end from becoming unwound. In this manner, both ends of the strap can be quickly and easily secured around the frame, and the strap can be longitudinally adjusted as desired depending upon the vertical adjustment position of the mattress.

Referring to FIG. 12, there is illustrated therein yet another version of the invention specifically designed to permit longitudinal adjustment of the strap relative to the frame. In FIG. 12, the strap 56 has a generally rectangular wedge mounted on the underside thereof, similar to the FIGS. 1–2 forms of the invention. It will be understood in this regard that one or a plurality of such wedges can be provided as long as the intended function of the wedge to space the strap from the mattress surface is maintained. At a location 70 which is as shown in FIG. 12 generally aligned with the frame of the bed, the strap is modified in construction so as to comprise two separate strap ends 72 and 74. The portion of the strap interconnecting the strap end 72 with the body of the strap is shown positioned over the frame member 52, and the connecting portion for the strap end 74 is shown positioned under the frame. When the strap is properly longitudinally oriented, the strap end 72 and 74 can then be tied together so as to maintain the strap 56 in a taut condition. If the mattress is vertically adjusted, or if it is for any other reason desired to relocate the strap longitudinally on the frame, the tied ends can simply be loosened, and retied, either at the same location or to a more desirable location consequent to the vertical adjustment of the frame. Rather than simply tieing the two loose ends 72 and 74 together, one of such ends can be provided with a buckle of any desired type with which the other end can be engaged so as to tighten the strap to the desired taut condition. In either event, the strap can be quickly loosened, located if desired, and retightened.

It will be noted that all of FIGS. 9–12 constitute fragmentary views and accordingly illustrate only a single wedge member, either positioned below or around the strap. It will be understood that a single, centrally located wedge can be used if it provides the desired result, a pair of wedges can be employed as spaced locations along the strap, or a plurality of wedges can be used as shown in FIGS. 1 and 2.

It will also be apparent that the material from which the strap is made in FIGS. 9–12, as well as in the earlier figures is not critical to the practice of the invention concepts. The straps can be made of cloth or other textile materials, synthetic materials, or possibly combinations of these. Likewise, the wedges can be formed of any suitable material, and both the wedges and the straps, if desired, can be coated with a water or stain resistant material or other materials which facilitate cleaning and washing.

I claim:

1. A foot supporting strap for beds comprising:

(a) a strap having a length longer than the width of the bed whereby the ends of the strap extend downwardly over the sides of the bed;

(b) mounting means at the ends of said strap for detachably mounting said strap to a frame or other parts of said bed, and (c) means at least on the underside of said strap for spacing said strap from the mattress of the bed, whereby in the regions adjacent said spacing means there is formed a space into which the feet of the patient can at least partially extend, said strap providing a brace against which the feet of the patient can push to permit movement of the patient to a more comfortable position.

2. The supporting strap of claim 1 wherein said mounting means comprises a hook secured to each end of said strap, said hook being locked around said strap after said strap has been made taut.

3. The supporting strap of claim 1 wherein said mounting means comprise free ends of said strap wrapped around adjoining parts of said bed, said free ends being then secured to themselves to maintain the strap taut.

4. The foot supporting strap of claim 1 wherein said mounting means comprises a pair of strap ends at opposite ends of said strap, said strap ends at each side being tightly secured to retain said strap in a taut condition.

5. The foot supporting strap of claim 1 wherein said spacing means comprises at least one generally circular, slotted wedge member extending over said strap and serving to space said strap from the mattress.

6. The foot supporting strap of claim 5 further including a plurality of wedge members.

* * * * *